US005429445A

United States Patent [19]

Un-tae

[11] Patent Number: 5,429,445

[45] Date of Patent: Jul. 4, 1995

[54] RING BINDER HAVING PAPER PUNCH MECHANISM

[76] Inventor: Chung Un-tae, 20-21, Chungdam-dong, Kangnam-gu, Seoul, Rep. of Korea

[21] Appl. No.: 267,538

[22] Filed: Jun. 29, 1994

[30] Foreign Application Priority Data

Aug. 30, 1993 [KR] Rep. of Korea ..... 16931/1993
Feb. 23, 1994 [KR] Rep. of Korea ..... 3329/1994

[51] Int. Cl.[6] ..... B42F 13/40
[52] U.S. Cl. ..... 402/1
[58] Field of Search ..... 402/1, 80 R, 32, 33, 402/39, 41, 79; 281/50

[56] References Cited

U.S. PATENT DOCUMENTS 2,139,159 12/1938 Hammern .
4,749,297 6/1988 Roy .
5,273,370 12/1993 Bland et al. .

FOREIGN PATENT DOCUMENTS 406079994 3/1994 Japan ..... 402/1

*Primary Examiner*—Frances Han
*Attorney, Agent, or Firm*—Robert E. Bushnell

[57] ABSTRACT

A ring binder/paper punch combination having a ting member housing, mounted on a spline of a binder cover, in which spring plates biasing the ring member are housed, a paper sheets insertion frame being disposed between the ring member housing and the spline of the binder cover has upper and lower punching holes aligned with the positions of the ring members and a gap opened toward the front side of the insertion frame, a cover mounted on the ring member housing has openings on the top at both ends. Punching rods are extended from a punching rod block housed in the cover and are inserted into punching rod guide tubes mounted to align with the punching holes in the insertion frame. Depression levers for depressing the punching rod block have inner ends being pivoted by pins in the cover, the depression levers have downward protruding points located between the inner ends and the outer ends thereof for contacting an upper position of the punching rod block and have knobs attached to the outer ends, the knobs being exposed in the openings of the cover.

7 Claims, 6 Drawing Sheets

RING BINDER HAVING PAPER PUNCH MECHANISM

CROSS-REFERENCE TO RELATED APPLICATION

This application makes reference to, incorporates the same herein, and claims all benefits incurring under 35 U.S.C.§119 from applications filed in the Korean Industrial Property Office on 30 Aug. 1993 and 23 Feb. 1994 and respectively assigned serial Nos. 16931/1993 and 3329/1994.

BACKGROUND OF THE INVENTION

The present invention relates to a ting binder having a paper punch mechanism, and particularly to a ting binder having a paper punch mechanism with punching rods, aligned with ring members, placed within a spring plate housing having said ring members for binding paper sheets, wherein the paper path mechanism can punch holes in paper sheets inserted into a gap formed in a lower side of the spring plate housing.

In general, a ting binder has the construction of a ting member fixed to a spring plate, the spring plate is housed within a housing, and the housing is fixed on an inside surface of a spline of a binder cover. In most cases, the ting binder has two or three ring members and the paper sheets are bound in the ring members through the punched holes of the numbers corresponding to the ring members.

Conventional ring binders are disclosed in U.S. Pat. Nos. 4,522,526, 4,573,822, 4,582,442, 4,690,580 and 4,722,628, an in other references. In using the ring binder, every hole aligned with the ring member must be punched through the paper sheets in advance. To punch such a hole, a separate punch mechanism is necessary.

In order to overcome the problem of having a punch mechanism separate from a ring binder the following U.S. patents disclose different embodiments of a combination of loose leaf binder rings and paper punch mechanism.

In U.S. Pat. No. 2,139,159 by C. B. Hammon entitled *Loose Leaf Binder*, a loose leaf binder is disclosed as having an apparatus with hinged upper and lower plates wherein the upper plate includes hole punches and is raised and lowered to punch holes through a sheet of paper. The hole punches are aligned with the rings in the binder mechanism.

In U.S. Pat. No. 4,749,297 by Norman L. Roy entitled *Loose-Leaf Binder And Paper-Punch Combination*, a loose leaf binder and paper punch combination has an opening in a lower portion thereof to allow for the insertion of paper in order to punch holes in said paper. Arms of the rings are open, thus causing hinge plates to pivot and thereby causing punches to pivot towards the hinge plate; this causes the head of the punch to penetrate openings in the hinge plate thereby punching holes in said paper insert in the opening.

In U.S. Pat. No. 5,273,370 by Robert E. Bland, et al. entitled *Hole Punching Device For A Ringed Notebook*, a hole punching device for a ring note book utilizes the opening of arms of the rings to operate the punch member and a housing which moves downward in response to the opening of the ring, thus causing a portion of the punch to penetrate paper and a cutting hole in the platform on which the housing is mounted, the platform having an opening in which the paper is inserted for holes to be punched therein. Bland et al. further discloses a mechanism which does not require the arm to open or closed to operate the punch; this mechanism comprises a spring disposed between a hinge plate and a ledge of the platform. Holes are punched by the hole binder mechanism being pushed downward and the spring returns the binder mechanism to its upward position.

SUMMARY OF THE INVENTION

Contemporary devices such as those described in the foregoing references tend to be complex in construction and cumbersome in use.

It is therefore, an object of the present invention to provide an improved ting binder and hole punch mechanism.

It is another object to provide a ring binder assembled with a paper punch mechanism by which holes of paper sheets can be simply punched when the paper sheets are to be bound in the ring binder.

It is yet another object to provide a ring binder which paper sheets are simply bound in a ring member wherein only one punching operation is performed by placing a punching rod in aligned position with the ring member thereby aligning the position of holes punched in the paper sheets with the position of the ring member.

It is a further object to provide a ring binder having a punching rod lowered for performing a punching operation at the same time two arcuate portions of the ring member a e opened, and thus the paper sheets having punched holes can be bound without necessity of operating the ring member separately after the punching operation.

It is a still further object to provide the ting binder in which a punching rod block having several punching rods is simply depressed.

These and other objects may be achieved with a ring binder having a paper punch mechanism constructed according to one aspect of the present invention with a ring member housing mounted on a spline of a binder cover. Spring plates retaining the ring member are housed in the spline, a paper sheet insertion frame is mounted between the ring member housing and the spline of the binder cover has upper and lower punching holes aligned with the position of the ring members and a gap opened toward the front side of the housing. A cover is mounted on the ring member housing and has openings on the top at both ends. Punching rods extend from the punching rod block housed in the cover and are inserted into punching rod guide tubes mounted to align with the punching holes in the ring member housing, and with depression levers for depressing the punching rod block. The depression levers have inner ends being pivoted by pins in the cover, the depression levers contain an upper position of the punching rod block and have knobs exposed toward the openings of the cover are formed on its outer ends and a downwardly bent depression point is formed in the middle.

On the spline of the binder cover, discharge holes are aligned with the upper and lower holes of the paper sheets insertion frame to enable discharge of punched scraps of the paper.

Springs biased upwards to the punching rod block are placed around the punching rods between the punching rod block and the aforesaid ring member housing.

Lifting levers are placed such that a downward protrusion is formed at a lower side of the knobs of the depression levers, and the ting members are opened by the rising of the spring plates when the downward protrusion is lowered at the adjacent ends of the spring plates fixing the ring members.

A ring binder having a paper punch mechanism constructed according to a second aspect of the present invention comprises a ring member housing mounted on the spline of a binder cover in which spring plates fixing the ring member are housed, a paper sheet insertion frame being mounted between the ring member housing and the spline of the binder cover has upper and lower punching holes aligning the position of the ring members and has a gap opened toward one side of the insertion frame, a cover mounted on the ring member housing has openings on the top at both ends, and punching rods being extended from a punching rod block housed in the cover and being inserted into punching rod guide tubes mounted to align a punching hole in the ring member housing, wherein knobs for depression are exposed toward the openings of the cover and are respectively connected to each end of the punching rod block.

A ring binder having a paper punch mechanism constructed according to a third aspect of the present invention comprises a ting member housing mounted on a binder cover in which spring plates fixing the ting member are housed, a paper sheet insertion frame being mounted between the ting member housing and the binder cover. The insertion frame has upper and lower punching holes aligned with the position of the ring members and has a gap opened toward one side of the insertion frame, a punching rod block being housed below the spring plates and having ends which are biased upwards by the spring plate. Short punching rods are formed integrally with the punching rod block, the rods having ends which are inserted into upper side punching holes of the paper sheets insertion frame, and depression levers enabling an operator to downwardly depress the punching rod block with its inner ends being pivoted on pins in the ring member housing, in which knobs exposed toward the openings on both ends of the ring member housing are formed on its outer ends, and a downwardly bent depression point is formed in the middle.

These and other objects and novel features of the present invention will become more apparent from the following description when taken in conjunction with the accompanying drawings.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENT

Figure 1:
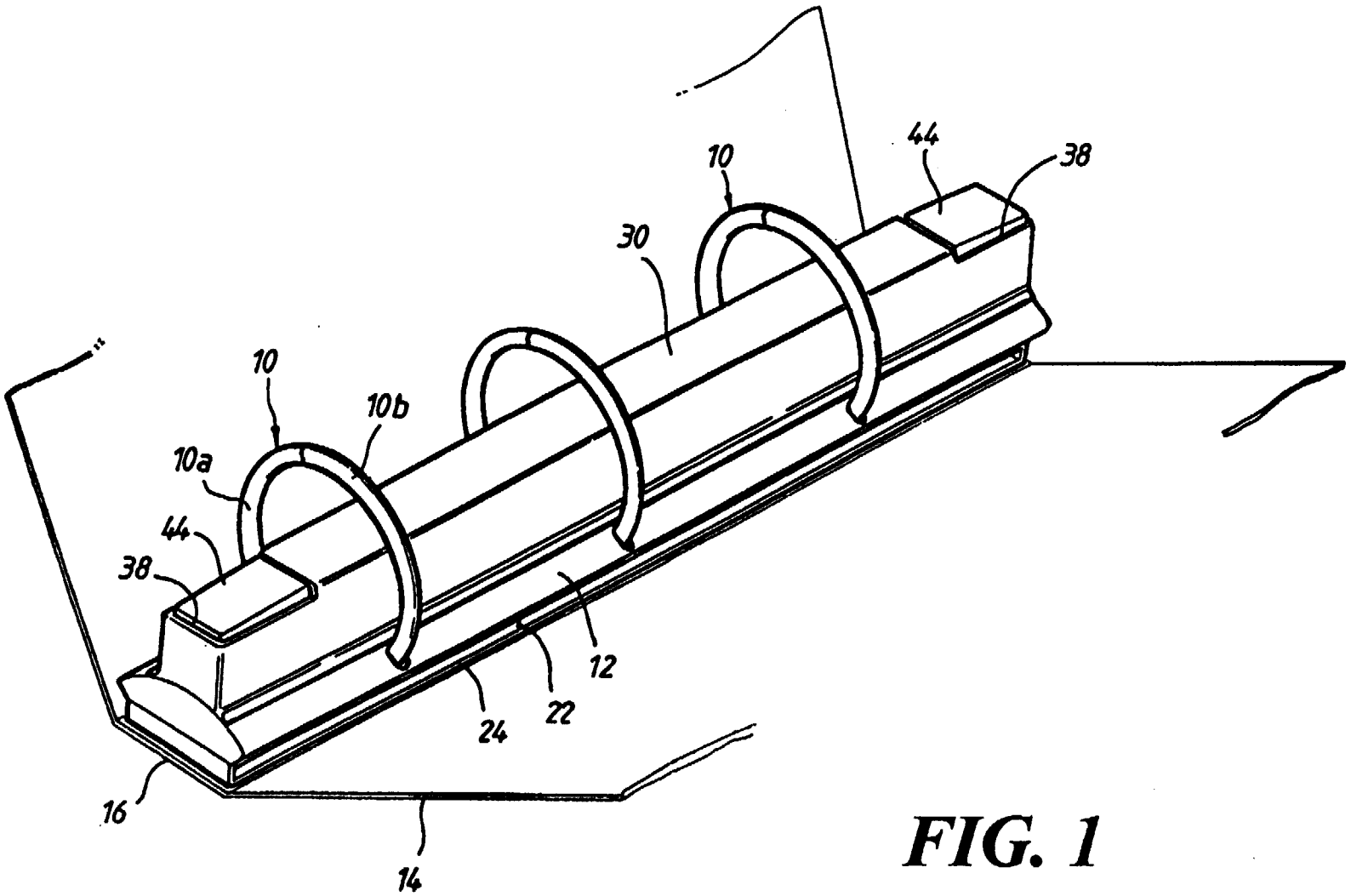
FIG. 1 is a perspective view of one embodiment according to the principles of present invention.

Hereinafter, the present invention will be described in detail with reference to the accompanying drawings.

FIGS. 1 to 4 show a ring binder of a first embodiment according to the present invention. A ring member housing 12 in which ting members 10 having two arcuate portions 10*a*, 10*b* respectively are mounted on spline 16 of a binder cover 14. Within the ring member housing 12, there are spring plates 18*a*, 18*b* for opening or closing the two arcuate portions 10*a*, 10*b* of the ring members 10, the ring members 10 are mounted thereto, FIG. 4.

A paper sheets insertion frame 24 is mounted at the bottom of the ting member housing 12. The frame 25 has upper and lower punching holes 20*a*, 20*b*, FIG. 2 formed to align with the position of the ring members 10 and a gap 22 opened to one side for inserting paper sheets. On the spline 16 of the binder cover 14, punched scraps discharge holes 26 aligned to the punching holes 20*a*, 20*b* are formed, FIG. 4.

Figure 2:
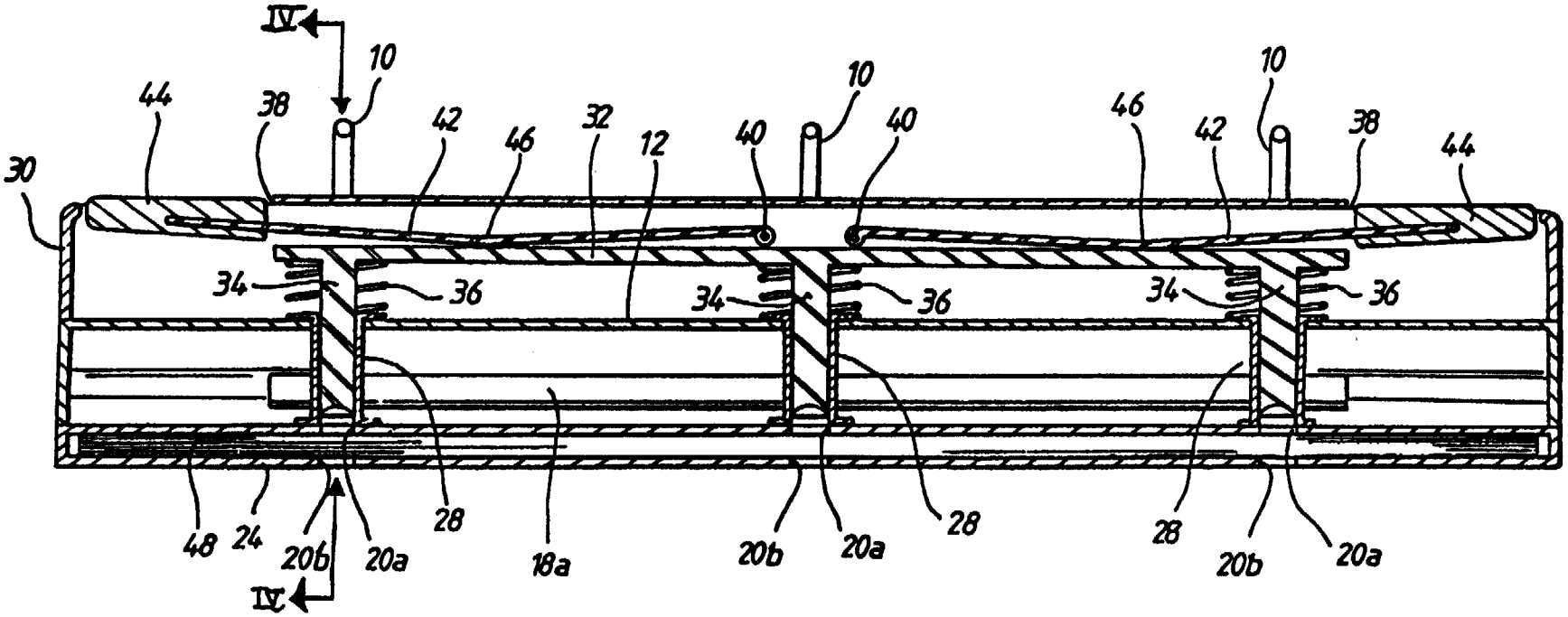
FIG. 2 is a sectional view of the embodiment shown in FIG. 1.
Figure 3:
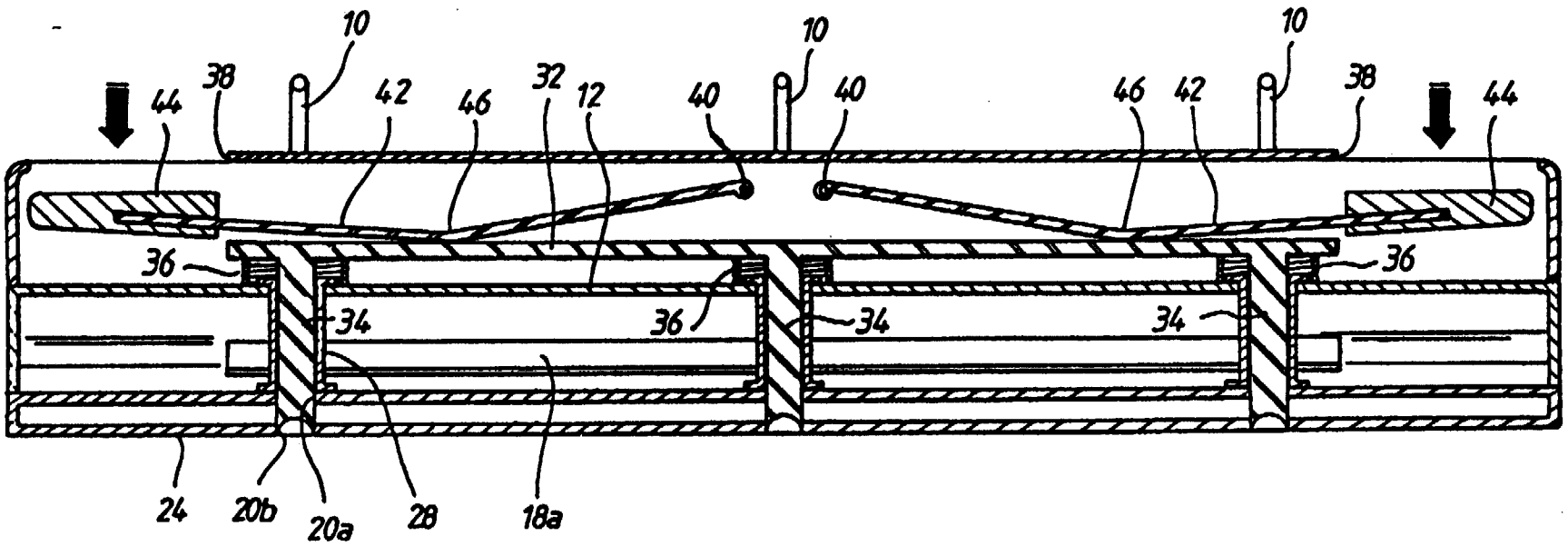
FIG. 3 is a sectional view similar to FIG. 2, illustrating the state of a lowered punching rod.
Figure 4:
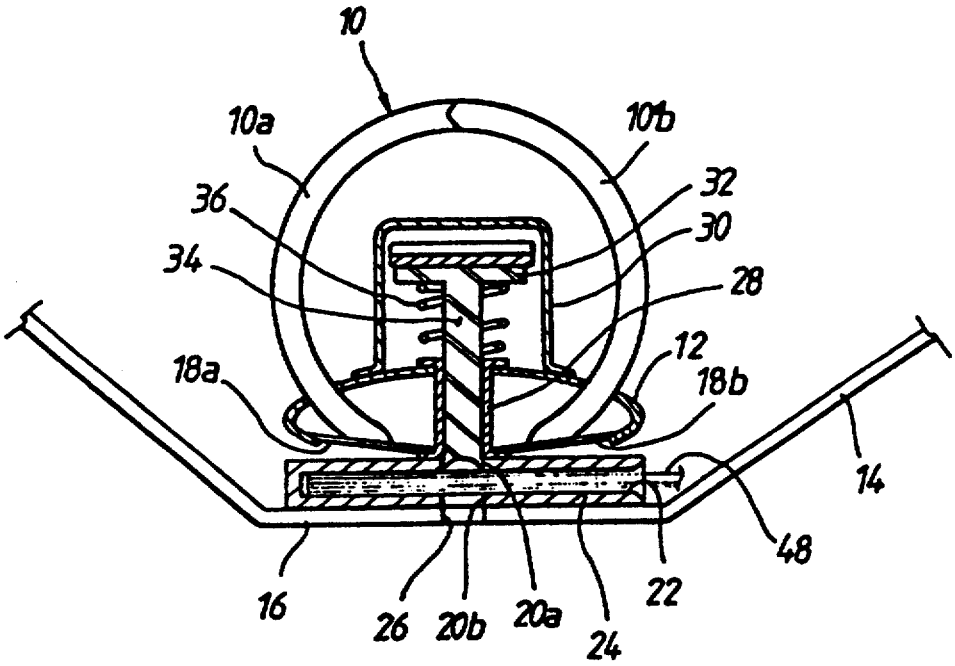
FIG. 4 is a sectional view taken on line IV—IV of FIG. 2.

In the ring member housing 12, FIG. 2, punching rod guide rubes 28 is mounted to align the punching holes 20*a*, 20*b* in the middle position of the arcuate portions 10*a*, 10*b*, and a cover 30 is mounted lengthwise on the top of the ting member housing 12. in the cover 30, a punching rod block 32 is housed lengthwise, and from the lower side of the punching rod block, punching rods 34, extending to the punching rod guide tube 28, are integrally formed. In the punching rods 34, springs 36 are placed between the punching rod block 32 and the ring member housing 12.

On both ends of the cover 30, openings 38 are formed and pins 40 are mounted oppositely in the middle position therein. on the pins 40, one ends of a pair of opposite depression levers 42 for depressing the punching rod block 32 are mounted. The other ends, i.e., the free ends, of the depression levers 42 are positioned at the side of the opening 38 of the cover and knobs 44 are fixed thereto. Such depression levers 42 are downwardly bent on its middle portion and thus a depression points 46 are formed, respectively.

In the aforesaid first embodiment of the present invention, the punching rod block 32 is normally placed by the springs, i.e.,compression springs, 36 at the raised position (see FIG. 2).

To punch a hole in paper sheets 48 to be bound in the ting member 10 of the ting binder, one side of the paper sheets 48 is inserted into the gap 22. The knobs 44 of the depression levers 42 placed in the opening 38 on both ends of the cover 30 are simultaneously depressed, FIG. 3.

The depression levers 42 depress the punching rod block 32, by contact of the downwardly bent depression points 46, against the force of the springs 36.

When the punching rod block 32 is downwardly depressed, the punching rods 34 are lowered, and the punching rods 34 and the punching holes 20*b* at the bottom of the paper sheets insertion frame 24 interact and thus holes are punched into paper sheets 48. Punched scraps of paper are discharged through the punched scraps discharge holes 26 formed in the spline 16 of the binder cover 14. After that, if the force of depressing the depression levers 42 is removed, the punching rods 34 are guided upwards in the inner punching rod guide tubes by means of force of the springs 36 against punching rod block 32.

The paper sheets 48 having punched holes can be bound after opening the ring members 10 since the holes align with the position of the ring members 10.

Figure 5:
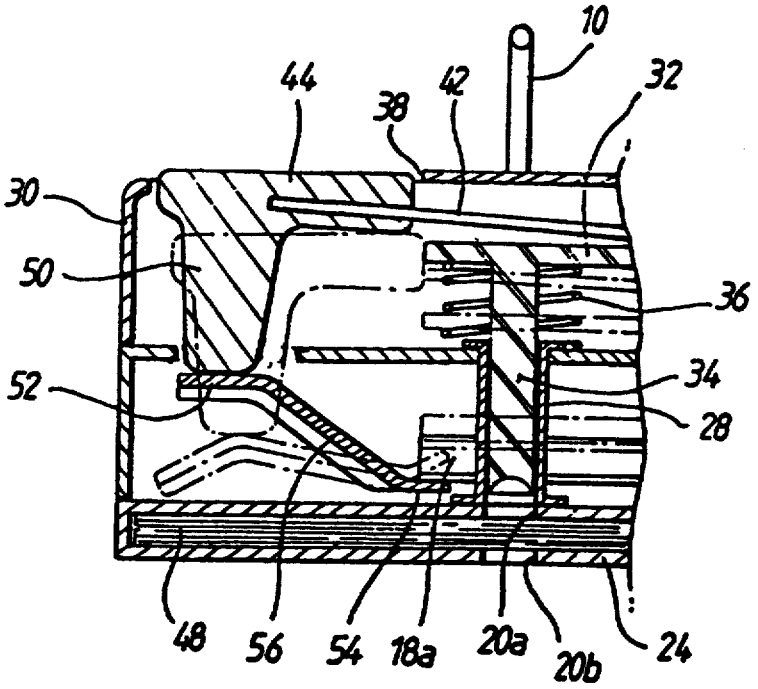
FIG. 5 is a fragmentary sectional view illustrating the second embodiment constructed according to the principles of the present invention.

FIG. 5 illustrates a second embodiment of the present invention. At the lower side of the knobs 44 of the depression levers 42, downward protrusions 50 are formed. At the end side of the spring plates 18*a*, 18*b* in which the ring members are mounted, lifting levers 56 are placed at the end bottom of the spring plates 18*a*, 18*b*, with its upper end 52 being adjacent to the downward protrusion 50 and lower end 54 being placed at the end bottom of the spring plate 18*a*, 18*b*. Besides that, other parts of the second embodiment are equal to I those of the above described first embodiment.

In the second embodiment, when the knobs 44 of the depression levers 42 are depressed to punch holes in the paper sheets 48, the upper end 52 of the levers 56 is depressed by the downward protrusion 50 of the knob 44 and the spring plates 18*a*, 18*b* are raised by the lower end 54 of the lifting levers 56 such that the arcuate portions 10*a*, 10*b* of the ring member 10 are opened at the same time the paper sheets have holes punched therein, thereby enabling the paper sheets to be bound in the ring members 10, right away.

Figure 6:
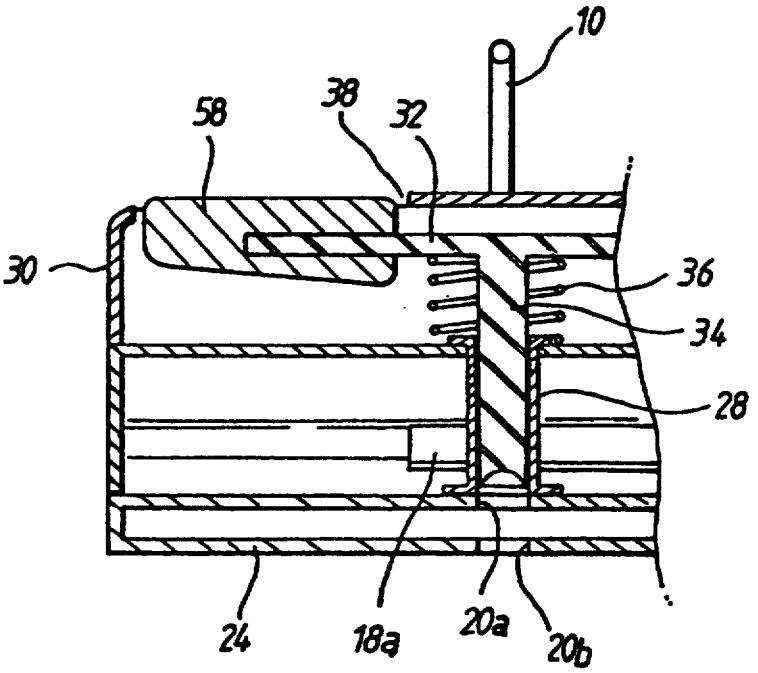
FIG. 6 is a fragmentary sectional view illustrating the third embodiment constructed according to the principles of the present invention.

FIG. 6 illustrates a third embodiment of the present invention. Knobs 58 are mounted at the ends of the punching rod block 32 in which the punching rods 34 are integrally formed, and the depression lever 42 of the first embodiment may be omitted. Besides that, other parts of the third embodiment are equal to those of the first embodiment. In the aforesaid third embodiment, the holes of the paper sheets are punched by depressing the knobs 58 of the punching rod block 32. This embodiment has the benefits of lowering the height of the cover 30 in comparison with the other embodiments.

Figure 7:
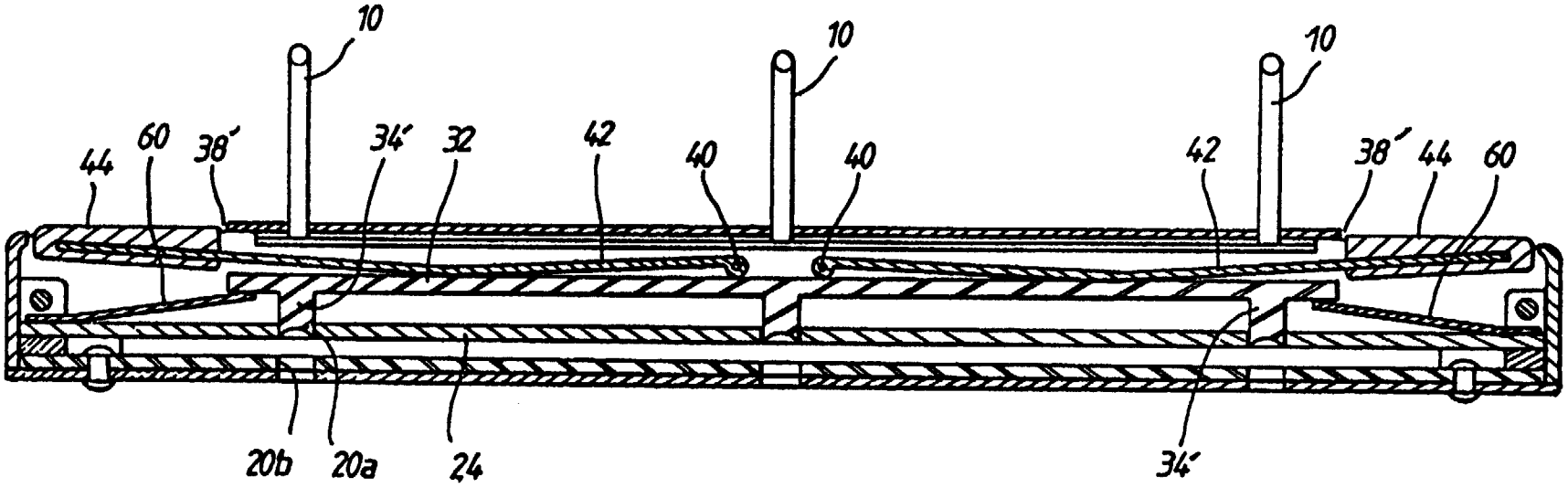
FIG. 7 is a fragmentary sectional view illustrating the fourth embodiment constructed according to the principles of the present invention.

FIG. 7 illustrates the fourth embodiment of the present invention. On the punching rod block 32, a short punching rods 34' are integrally formed and without the punching rod guide tubes, its end is extended to the upper punching hole 20*a* of the paper sheets insertion frame 24, and the punching rod block 32 is upwards biased by plate springs 60 mounted on both ends of the upper surface of paper sheets insertion frame 24. In the fourth embodiment of the present invention, height of the punch mechanism is so low that the punch mechanism can be housed in the ring member housing 12 without the cover 30. The ring member housing 12 has openings 38' similar to the openings 38 in cover 30 of the first embodiment.

While particular examples of the present invention have been shown and described, it is apparent that the changes and modification may be made therein without departing from the scope of the invention. The aim of the pending claims, therefore, is to cover all such changes and modification as fall within a true spirit and scope of the invention.

What is claimed is:

1. A ring binder having a paper punch mechanism, which comprises:

a ring member housing mounted on a spline of a binder cover in which spring plates for biasing ring members are housed:

a paper sheets insertion frame being mounted between said ring member housing and said spline of said binder cover, said paper sheets insertion frame having upper and lower punching holes aligned with the position of said ring members and a gap opened toward a front side of said paper sheets insertion frame;

a cover mounted on said ring member housing and having openings on opposite ends of an uppermost surface of said cover;

punching rods being extended from a punching rod block housed in said cover and being inserted into respective punching rod guide tubes mounted to align with said upper and lower punching holes in said paper sheets insertion frame; and depression levers for depressing said punching rod block, said depression levers each having inner ends being pivoted by pins mounted in said cover, centrally located downwardly bent depression points contacting an upper position of said punching rod block, and outer ends on which are formed knobs exposed in said openings in said cover.

2. A ring binder having a paper punch mechanism as set forth in claim 1, further comprising punched scraps discharge holes formed in said spline of said binder cover and aligned with said upper and lower holes of said paper sheets insertion frame.

3. A ring binder having paper punch mechanism as set forth in claim 1, further comprising springs for biasing said punching rod block upwards, each of said springs being placed around a respective one of said punching rods and being disposed between said punching rod block and said ring member housing.

4. A ring binder having paper punch mechanism as set forth in claim 1, further comprising lifting levers attached to opposite ends of said spring plates and being placed such that a downward protrusion formed on a lower side of each of said knobs force said lifting levers downward when said knobs are depressed for causing said lifting levers to raise said spring plates upward to open said ring members while said depression points of said depression levers simultaneously lower said punching rod block to cause said punching rods to pass through said upper punching holes and into said lower punching holes.

5. A ring binder having a paper punch mechanism, comprising:

a ring member housing in which spring plates, for opening and closing ring members, are housed, said ring member housing being mounted on a binder cover;

a paper sheets insertion frame disposed between said ring member housing and said binder cover, said paper sheets insertion frame having upper and lower punching holes aligned with said ring members, and a gap formed in a front side of said paper sheets insertion frame;

a cover mounted on said ring member housing, said cover having openings on opposite ends of a top portion of said cover;

punching rods extending from a lower portion of a punching rod block housed in said cover, said punching rods being inserted into respective punching rod guide tubes aligned with said upper punching holes; and knobs attached to opposite ends of said punching rod block, said knobs extending into respective ones of said openings in said cover, said punching rods being forced through said upper and lower punching holes by said knobs being depressed to deforce said punching rod block in a downward direction.

6. The ring binder having a paper punch mechanism as set forth in claim 5, further comprising:

springs for biasing said punching rod block upwards, each of said springs being placed around a respective one of said punching rods and being disposed between said punching rod block and said ring member housing.

7. A ring binder having paper punch mechanism, which comprises:

a ring member housing, mounted on a spline of a binder cover, in which spring plates for baising ring members in open and closed positions are housed;

first and second openings in opposite ends of a top portion of said ring member housing;

a paper sheets insertion frame disposed between said ring member housing and said spline, said paper sheets insertion frame having upper and lower punching holes aligned with said ring members, said paper sheets insertion frame having a gap opened toward one side thereof for receiving paper in which holes are to be punched;

plate springs mounted on opposite ends of an upper surface of said paper sheets insertion frame;

a punching rod block being housed in said ring member housing and disposed below said spring plates, said punching rod block having opposite ends being biased upwards by said plate springs;

short punching rods being formed integrally with said punching rod block, said short punching rods having ends which are inserted into respective ones of said upper punching holes; and depression levers for depressing said punching rod block, said depression levers each having inner ends being pivoted by pins mounted in said ring member housing, centrally located downwardly bent depression points contacting an upper position of said punching rod block, and outer ends on which are formed knobs exposed in said openings in said ring member housing.

* * * * *